United States Patent [19]

Runnells

[11] 4,093,308

[45] June 6, 1978

[54] DENTAL OPERATING CHAIR WITH RESTRAINING ARM SUPPORTS

[75] Inventor: Robert R. Runnells, Kaysville, Utah

[73] Assignee: MDT Instrument Company, Tualtin, Oreg.

[21] Appl. No.: 684,659

[22] Filed: May 10, 1976

[51] Int. Cl.[2] ..... A47C 7/54

[52] U.S. Cl. ..... 297/416

[58] Field of Search ..... 297/411, 416, 414, 415, 297/418

[56] References Cited

U.S. PATENT DOCUMENTS

| | | | |
|---|---|---|---|
| 644,643 | 3/1900 | Sibley | 297/416 |
| 2,477,898 | 8/1949 | Rehman et al. | 297/411 |
| 2,614,558 | 10/1952 | Lovell | 248/118 |
| 2,766,463 | 10/1956 | Bendersky | 297/411 |
| 3,191,994 | 6/1965 | Boyce | 297/411 |
| 3,215,470 | 11/1965 | Swenson et al. | 297/418 |
| 3,222,105 | 12/1965 | Cross | 297/411 |
| 3,223,448 | 12/1965 | Naughton | 297/411 |

FOREIGN PATENT DOCUMENTS

| | | | |
|---|---|---|---|
| 546,773 | 3/1932 | Germany | 297/411 |

*Primary Examiner*—Roy D. Frazier
*Assistant Examiner*—Peter A. Aschenbrenner

[57] ABSTRACT

A dental operating chair includes a movable back member which can be adjusted to position a patient in a substantially supine posture. Arcuately formed arm supports which curve toward the patient are removably secured along the opposite longitudinal sides of the back member to retain the arms of a patient proximate his body truck. The arm supports include means which permit them to pivot toward and away from the patient. The internal surfaces of the supports are shaped to clasp the patient's arms and the edges of the supports are shaped for easy contact by the body of a dentist to cause them to pivot toward the patient.

5 Claims, 5 Drawing Figures

DENTAL OPERATING CHAIR WITH RESTRAINING ARM SUPPORTS

BACKGROUND OF THE INVENTION

1. Field

This invention relates to dental operating chairs of the type having a back member which can be adjusted to position a patient in a substantially supine posture. More specifically, this invention provides restraining arm supports for use with such chairs.

2. State of the Art

In treating dental patients today, the patient is frequently positioned in a substantially horizontal position (i.e., a substantially supine posture). The dentist or technician treating the patient is seated proximate the patient near the upper portion of the patient's body. On some occasions, such as oral surgery, the patient may be anesthetized. As a result of the anesthesia, some patients lose some or all control over their extremities. That is, the patient becomes unable to hold his arms proximate his body trunk. The patient's arm may fall toward the dentist or technician so as to interfere with the treatment being administered Arm supports heretofore typically provided for dental operating chairs have been located to provide support when the patient is sitting in an erect or angularly reclined position. U.S. Pat. No. 2,844,193 (Lauterbach) and U.S. Pat. No. Re. 26,241 (Naughton) disclose arm supports of this type. The arm supports therein disclosed are optional structures in which the arms may be positioned for support, but they do not adequately restrain the arms during surgery. Other known arm supports or arm restraining devices include those disclosed in U.S. Pat. Nos. 2,873,122 (Peras); 297,384 (White, Sept. 15, 1885); 1,543,612 (Pascaud); 3,424,493 (Gottfried, et al.); 3,773,382 (Coursault, et al.); and 3,095,235 (Babcock, et al.).

SUMMARY OF THE INVENTION

This invention provides a dental operating chair having conventional seat and reclining back members which can be adjusted to position the patient in a substantially supine posture. Arm support means are removably secured by attachment means along opposite longitudinal sides of the back member to restrain the arms of the patient. The patient's arms are held approximate his body trunk. The arm support means may extend generally perpendicularly forward from the back member, and are desirably arcuately formed to curve toward the patient. The attachment means may be adapted to attach removably to the back member. Hinge means connect the arm support means to the attachment means so that the arm support means may be pivoted toward and away from the patient.

In one embodiment, the hinge means is spring-loaded and biased to an at rest position which holds the arm supports generally perpendicular to the back member. The attachment means may include an elastic band that tensionally encircles the back member or alternative means adapted for easy connection or removal from the back member of the chair.

BRIEF DESCRIPTION OF THE DRAWINGS

In the drawings, which illustrate the best mode presently contemplated for carrying out the invention.

DESCRIPTION OF THE ILLUSTRATED EMBODIMENT

Figure 1:
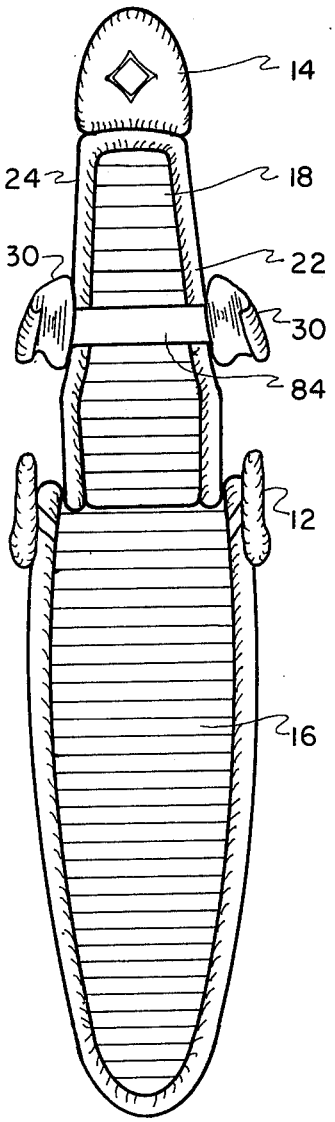
FIG. 1 is a top plan view of a dental operating chair showing one form of the arm supports of the invention.

FIG. 1 depicts a dental operating chair comprised of conventional arm rests 12, an adjustable head rest 14, a seat member 16 and a back member 18. The back member 18 is movable between an upright position and the illustrated more-or-less horizontal position. With the back in horizontal position, a patient is oriented in a substantially supine posture. A dentist or technician may thus be seated on a stool or the like while attending the patient. The patient may be anesthetized (e.g., with nitrous oxide) during certain treatments, such as oral surgery. Depending on the amount and type of anesthetic, a patient may lose consciousness and/or lose physical control of his extremities, in particular his arms.

In such cases, the patient's arms may fall over the longitudinal sides 22, 24 of the back member 18. The uncontrolled arms interfere with the activities of the dentist or technician by restricting access to the patient or by interrupting the treatment procedures. Some patients may unwittingly position their arms in a manner which similarly interferes with dental procedures, even when they are not anesthetized. The restraining and retaining arm supports 30 of this invention avoid such problems without inhibiting access to the patient by the dentist or technician.

Figure 2:
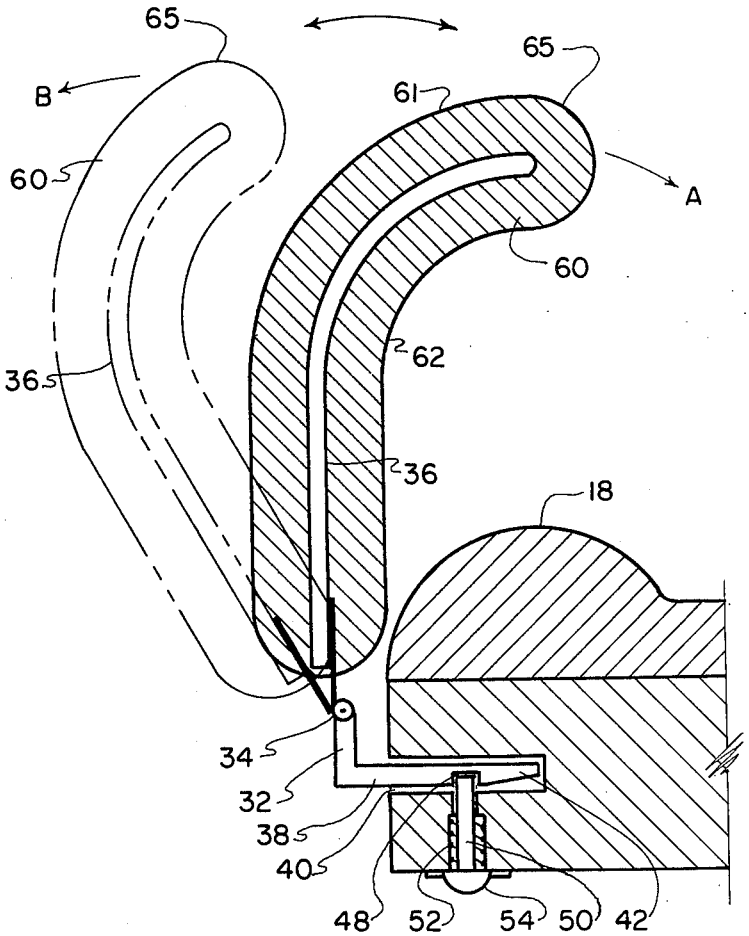
FIG. 2 is a fragmentory view of the back member and arm support means of a dental operating chair of the invention showing an arm support in cross section in one position and in phantom lines in a second position.

The arm supports 30 are removably secured to the back member 18 by attachment means of various types. As illustrated (FIG. 2), a preferred form of securing means 32 includes a spring-loaded hinge 34. An internal member 36 of each arm support 30 is secured directly to the hinge 34. In the at rest position, as illustrated in FIG. 2, the supports 30 extend generally perpendicularly away from the back member 18. The attachment means 32 also includes connector means which is comprised of the angle member 38 and an aperture 40 formed in the back member 18. The insertable portion 42 of the angle member 38 is substantially the same size as the aperture 40 so that it fits slideably and snugly into the aperture 40. The angle member 38 may have a detent 48 formed near its insertable end 42 which mechanically cooperates with a spring-loaded locking pin 50 to lock the side supports 30 to the chair back 18 as shown. The pin 50 is biased by a spring 52 into locking position and can be withdrawn with the fingers by a protruding head 54 so that the arm supports 30 may be removed.

The arm support 30 illustrated has an internal structural member 36 which is cushioned by appropriate padding 60. Preferably, the padding 60 substantially entirely surrounds the member 36 as illustrated to provide both an outer cushioned surface 61 for contact by the dentist or technician and an inner cushioned surface 62 for contact with the patient.

The arm supports 30 extend generally perpendicularly away from the back member 18 in the at rest position as shown in FIG. 2. If fixed in that attitude, they would often inhibit access by the dentist to the patient. That is, the dentist (or technician) would be blocked in his movements by the supports 30. Accordingly, it is highly desired that the arm supports 30 flex or pivot in a direction toward the patient, as indicated by the arrow A in FIG. 2. The dentist or technician can urge an arm support 30 in this direction A by contacting it with a portion of his body (typically, the body trunk, hips, forearms or elbows).

The outer surface 61 of the arm support 30 is desirably configurated more or less as shown to provide a ramped leading edge 65. Thus contact by a body portion moving generally in the direction indicated by the arrow B urges the arm support 30 in the direction A. Such movement is typical when a dentist reaches across a patient. As the dentist moves away from the patient, the arm support may move back to either a preset stop position inherent in the device or back into contact with the dentist. In either event, it is desirable for the inside surface 62 of the support 30 to be arcuately configurated as shown, especially near the leading edge 65, so that the patient's arms are not entirely released. In summary, the arm supports 30 are preferably arcuately formed with the arc curving inward toward the patient. The supports 30 thus form a partial enclosure or clamp which retains the patient's arms. The arc tends to limit upward movement of the patient's arms as the supports 30 are pivoted toward the patient. The arcuate shape of the supports 30 is exaggerated on the drawings for purposes of illustration. In practice, even a slightly arcuate bend of the internal member 36 is helpful.

Figure 3:
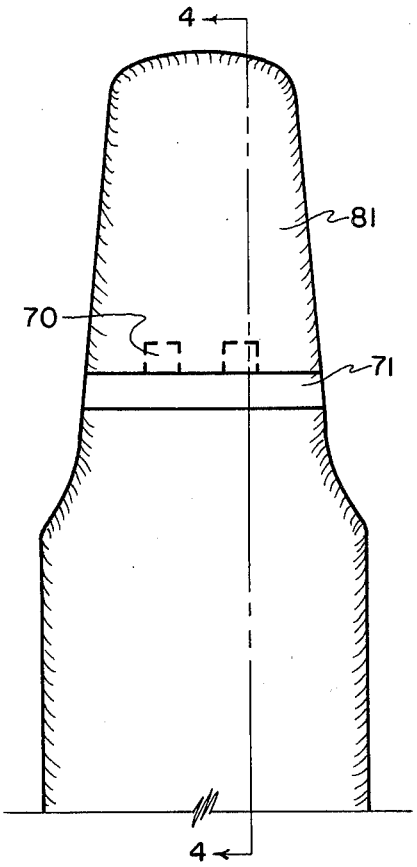
FIG. 3 is a view of the back member of a dental operating chair illustrating means of attachment for one form of an arm support of this invention.
Figure 4:
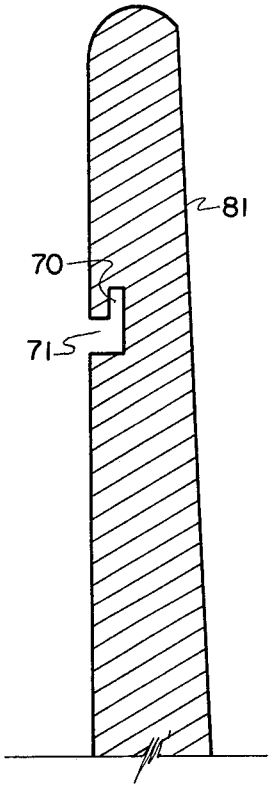
FIG. 4 is a cross-sectional view of the back member taken along the line 4—4 of FIG. 3 looking in the direction of the arrows.

Referring to FIGS. 3 and 4, arm supports 30 may be carried by a structural support adapted for attachment to the back surface of the back member 18. The structural support may be provided with upstanding tabs which are received by receptacles 70 communicating with a slot 71. The structural support desirably forms a snug fit within the slot 71.

Figure 5:
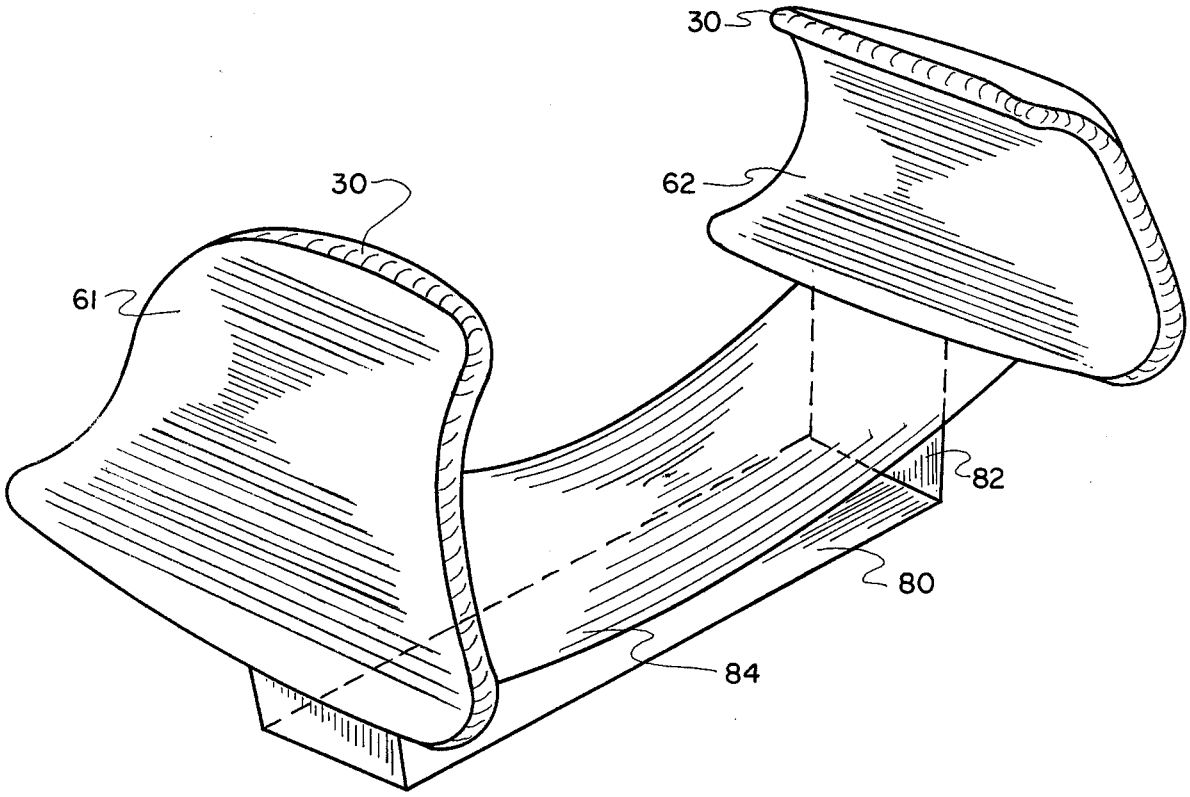
FIG. 5 is a perspective view of a preferred form of arm support means.

FIGS. 1 and 5 illustrate the preferred arrangement for securing the arm supports 30 to the back member 18. The arm supports 30 are fixedly secured to a rigid member 80. The supports may be hinged from short projections 82 which straddle the back 18. The member 80 is held against the back 18 of the chair by a strap 84 of fabric material. The fabric strap 84 is preferably sufficiently elastic to accommodate pivoting of the arm supports 30. The weight of a patient on the strap 84 will tend to pivot the supports 30 toward the patient. The arm supports 30 may be installed and removed by sliding the band defined by the member 80 and strap 84 over the head rest 14 and along the longitudinal sides 22, 24 of the back member 18.

Reference herein to details of the illustrated embodiments is merely illustrative of the invention. Such reference is not intended to limit the scope of the claims which themselves recite those features regarded as essential to the invention.

I claim:

1. In a dental operating chair of the type including a movable back member which can be moved to position a patient in said chair in a substantially supine posture, wherein the back member has opposite longitudinal sides, the improvement which comprises arm supports which are connected by a band that encircles said back member and are thereby removably secured along said opposite longitudinal sides of said back member constituting means for retaining the arms of a patient proximate the body trunk of said patient when said patient is in supine posture in said chair.

2. The improvement of claim 1 including means connecting said arm supports to said chair back which permit said arm supports to be pivoted toward and away from said patient through respective planes which are substantially normal to said back member and which respectively intersect said opposite longitudinal sides.

3. The improvement of claim 2 wherein said arm supports have a cushioned inside surface for contact with the arm of said patient and a cushioned outside surface for contact by a person attending to said patient.

4. The improvement of claim 3 wherein said arm supports have a portion which is arcuately formed to curve toward said patient.

5. The improvement of claim 1 wherein said band includes a rigid member which is held against the back and sides of said chair back and a flexible member which is held against the front of said chair back.

* * * * *